US005279242A

United States Patent [19]

Johnson

[11] Patent Number: 5,279,242

[45] Date of Patent: Jan. 18, 1994

[54] TILLER ARM FOR OUTBOARD MOTORS

[76] Inventor: W. Grant Johnson, 1642 Mockingbird Pl., Orange, Calif. 92667

[21] Appl. No.: 852,329

[22] Filed: Mar. 18, 1992

[51] Int. Cl.[5] ..... B63H 25/00

[52] U.S. Cl. ..... 114/144 R; 114/146; 440/53; 440/63

[58] Field of Search ..... 114/144 R, 144 A, 144 RE, 146, 142, 164, 167; 74/500.5, 501.6, 74/502; 440/63, 61, 62, 53; 244/232

[56] References Cited

U.S. PATENT DOCUMENTS

| | | | |
|---|---|---|---|
| 771,537 | 10/1904 | Dolliver | 114/144 R |
| 1,825,240 | 9/1931 | Miller | 115/18 |
| 1,860,173 | 5/1932 | Colstad . | |
| 2,402,724 | 6/1946 | Bidwell | 114/144 R |
| 2,543,553 | 2/1951 | McAllister | 114/144 R |
| 2,600,852 | 6/1952 | Coots | 74/471 |
| 2,615,418 | 10/1952 | Aspenleiter | 115/18 |
| 2,618,985 | 11/1952 | Morey | 74/484 |
| 2,624,212 | 1/1953 | Urquhart | 74/484 |
| 2,747,425 | 5/1956 | Ohlau | 114/162 |
| 3,136,288 | 7/1964 | Hardy | 115/70 |
| 3,636,911 | 1/1972 | Piazza et al. | 115/70 |
| 3,659,475 | 5/1972 | Nichols | 114/160 |
| 3,810,440 | 5/1974 | Johnson, Jr. | 114/144 R |
| 4,262,619 | 4/1981 | Hine | 114/144 R |
| 4,295,833 | 10/1981 | Borst | 440/63 |
| 4,419,084 | 12/1983 | Borst | 440/63 |
| 4,962,717 | 10/1990 | Tsumiyama | 114/144 R |
| 5,176,549 | 1/1993 | Ross | 440/63 |

FOREIGN PATENT DOCUMENTS

| | | | |
|---|---|---|---|
| 0907410 | 3/1946 | France | 440/63 |

*Primary Examiner*—Mark T. Le
*Attorney, Agent, or Firm*—Harold L. Jackson

[57] ABSTRACT

A remote control tiller arm is provided for controlling the operation of an outboard motor. An inverted U-shaped steering boom is attached to the outboard motor and extends over-the motor boat operator. The steering boom includes a throttle mechanism for remotely controlling the speed of the outboard motor. By using the steering boom, the motor board operator can steer the boat from a forward looking position.

34 Claims, 6 Drawing Sheets

1A
1A 10
16
18
20
30
34
36
38
40
42
52
60
62
64
66
68
70
72
80
82
84
86
88
90
92
94
96
98
5

TILLER ARM FOR OUTBOARD MOTORS

BACKGROUND OF THE INVENTION

1. Field of the Invention

The invention relates generally to steering control arms for outboard motors and more particularly to an overhead tiller arm control device for controlling the operation of an outboard motor.

2. Description of Related Art

Boating has provided enjoyment for thousand of water sport enthusiasts over the years. A preponderance of the boats are powered by small and medium sized outboard motors which are mounted on the transom at the stern or back of the boat. The typical outboard motor includes a short tiller arm extending outwardly and forwardly from the motor, the short tiller arm having a twist throttle handle attached thereto to control the speed of the motor. The motor boat operator sits at the stern of the boat where he steers the boat by swinging the short tiller arm from side to side in a substantially horizontal plane as needed to direct the boat in the desired direction. The speed of the boat is controlled by turning the twist throttle handle at the end of the tiller arm.

During many boating activities, such as fishing for example, it may be awkward for the operator to sit at the stern of the boat and reach backward to control the manual operation of an outboard motor while at the same time engaging in his fishing activity. In many instances it may be desireable to operate the boat from a location other than the stern of the boat. Additionally, it may be desirable to operate the boat from a forward looking position in either a standing or sitting position Furthermore, a direct steering arrangement which steers the boat in the same direction as the tiller arm is directed would make the motor boat easy to handle for even the inexperienced motor boat operator. The traditional outboard motor and tiller arm arrangement provides opposite steering and may cause confusion for some motor boat operators.

Attempts have been made to develop remote control devices for steering and operating the speed of outboard motors. For example, U.S. Pat. No. 2,624,212 entitled "Apparatus for Remote Control of Outboard Motor" to K. M. Urquhart discloses a remote control device for controlling both the steering and speed of an outboard motor which includes a straight rod which is attached at its rear end to the outboard motor. The straight rod is attached to the motor by a bracket and linkage arrangement which allows the operator, with one hand on the control rod, to steer the boat by pushing the rod forward or backward while simultaneously controlling the speed by twisting the rod slightly in either direction about its longitudinal axis. In another arrangement U.S. Pat. No. 2,600,852 entitled "Control Handle for Outboard Motors" to C. A. Coots discloses a control handle which includes a straight rod having a handle at the end thereof. The straight rod extends forwardly of the motor, the rear end of the straight rod being clamped to the motor by a bracket arrangement. Linkage is provided between the straight rod and the outboard motor throttle lever control know. The motor is steered by swinging the handle and rod from side to side in a horizontal fashion, and the speed of the motor is controlled by rotating the rod along its longitudinal axis by means of the handle attached at the end of the straight rod.

Disadvantageously, however, the remote control devices described above may be in the way of the motor boat operator when the operator desires to engage in a sporting activity such as fishing. Neither of the remote devices provides a desirable direct steering tiller arm arrangement. Additionally, the push-pull steering technique employed in Urquhart may be awkward and confusing to a motor boat operator, more so than even the traditional motor boat tiller arm steering arrangement. It would therefore be an advancement in the art to provide a simple yet reliable remote control arrangement for outboard motors.

SUMMARY OF THE INVENTION

It is therefore an object of the invention to provide a remote control tiller arm for an outboard motor which is simple and easy to operate.

It is another object of the invention to provide a remote control tiller arm of simple construction that is easy to install by lay persons without the need of special tools or skill.

It is still a further object of the invention to provide a remote control tiller arm that is relatively inexpensive to manufacture yet of reliable and durable construction.

It is an advantage of the present invention that a steering arm for an outboard motor is provided which an operator can operate from a forward facing standing or sitting position.

It is a feature of the present invention that the remote control steering arm can be readily swiveled or directed out of a motor boat operator's way when the boat is at rest such that the operator can engage in activities within the boat unencumbered.

A remote control tiller arm arrangement according to the present invention includes an arch-shaped or inverted U-shaped steering boom arm which extends upwardly from an outboard motor over an outboard motor operator then downwardly in front of the operator. The boom arm preferably comprises an L-shaped arm attached by bracket means to the outboard motor and extends upwardly and then forwardly over the boat operator therefrom. A downwardly depending rod is connected by means of a universal joint to the end of the overhanging L-shaped arm. The steering boom arm may include a throttle mechanism for controlling the speed of the boat and optionally the transmission shifting mechanism. A kill switch means for turning off the motor may also be provided. The motor boat can be steered by swinging the boom arm from side to side in a horizontal fashion while the operator is in either a seated or standing position facing forward.

DESCRIPTION OF THE PREFERRED EMBODIMENTS

Figures 1, 1A, 1B, 2:
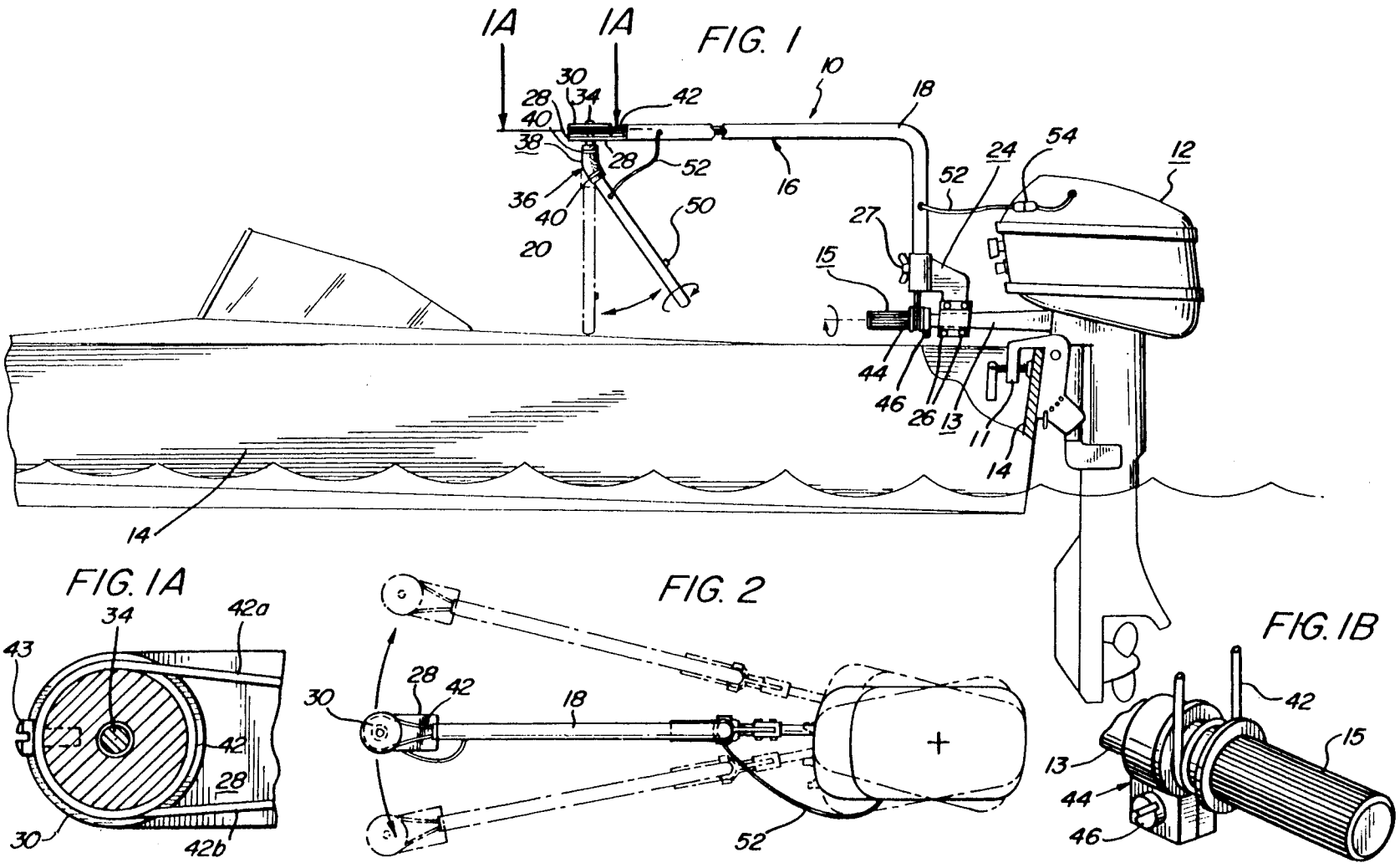
FIG. 1 is a side elevational view of a remote control tiller arm shown attached to an outboard motor in accordance with the principles of the invention.
FIG. 1A is a cross-sectional view of the throttle pulley arrangement on the tiller arm taken along lines 1A—1A in FIG. 1.
FIG. 1B is a perspective view of the collar and throttle cable arrangement affixed to the throttle handle of the outboard motor of FIG. 1.
FIG. 2 is a top view of the remote control tiller arm arrangement shown in FIG. 1.

Referring now with more particularity to the drawings, wherein like or similar parts are designated by the same numerals throughout the various figures, a remote control tiller arm arrangement 10 is illustrated in FIGS. 1 and 2 for controlling an outboard motor 12. The outboard motor 12 is typically attached to the transom 14*a* of the boat 14 by means of the motor's mounting clamps 11. A short tiller arm 13 extends forwardly from the outboard motor 12 and has a twist throttle handle 15 at the end thereof. The tiller arm arrangement in accordance with the principles of the invention includes an arch-shaped or U-shaped steering boom arm 16 which extends upwardly from the outboard motor 12 and extends forwardly over a portion of the boat 14. The steering boom arm 16 therefore passes over the boat operator with the forward end portion of the steering boom depending downwardly preferably in front of the motor boat operator (not shown) such that the operator can sit (or stand) looking forward and steer the boat 14 from that forward looking position. The steering boom arm 16 comprises an L-shaped rigid member 18 which may be in the form of a tube and a downwardly depending member or rod 20. The L-shaped rigid member 18 is securely attached at one end to the outboard motor short tiller arm 13 by mounting means including bracket 24, screws 26 and wing bolt 27.

At the other end of the L-shaped tube 18 is attached a flat plate 28 which extends from that end in a plane essentially perpendicular to a plane formed by the two legs of the L-shaped tube 18. Flat plate 28 may be attached to L-shaped tube 18 by welding, for example. A pulley 30 is rotably mounted on the top of plate 28 by pulley pin 34. Downwardly depending rod 20 is coupled to pulley pin 34 by means of a universal joint 36. The universal joint 36 may comprise thick rubber hose segment 38 which is clamped to depending rod 20 and pulley pin 34 by means of hose clamps 40. By means of the universal joint, the downwardly depending rod 20 advantageously can be tilted in various positions for ease of operation. A throttle control cable 42, formed in two sections 42*a* and 42*b*, is attached to the pulley 30 by a locking bolt (to prevent slippage between the cable section and the pulley) and extends through L-shaped tube 18 to a collar 44 affixed to the twist throttle handle 15 of the outboard motor 12 via bolt 46. See FIG. 1A. As is illustrated in FIG. 1B the sections 42*a* and 42*b* of the throttle cable may be connected together to form a loop around the collar 45. A bolt (not shown) may be used to prevent slippage between the cable sections and the collar. The speed of the outboard motor can thus be controlled by axial rotation of the downwardly depending rod 20 which turns pulley 30, which in turn extends one of the cable sections 42*a* or 42*b* and retracts the other cable section to rotate the twist throttle handle 15. This throttle means provides a simple yet reliable arrangement to remotely control the speed of the outboard motor.

Certain outboard motors are equipped with a transmission with a gear shifting mechanism responsive to the throttle position The described throttle means will allow the operator to shift gears as well as control the speed if motor so equipped.

A kill switch may also be included in this tiller arm arrangement by providing a switch 50 in downwardly depending rod 20 which is electrically connected to the outboard motor 12 by means of wire 52. Wire 52 extends through downwardly depending rod 20 and L-shaped tube 18 to be connected to the motor by electrical coupling 54. The kill switch when actuated may simply ground the high voltage wire to the spark plug in a conventional two or four cycle outboard motor.

The boom arm 16 provides convenient and leveraged steering control of the outboard motor 12, which can be turned from side to side by swinging the boom arm 16 from side to side. When the outboard motor is not being operated, the boom arm 16 can simply and advantageously be swung out of the operator's way. Additionally, the motor can be tilted up for inspection or other purposes by moving downwardly depending rod to one side, without the need to take off the entire tiller arm arrangement 10. The simple construction of the tiller arm arrangement 10 makes it simple and easy to install.

Figures 3, 4, 5:
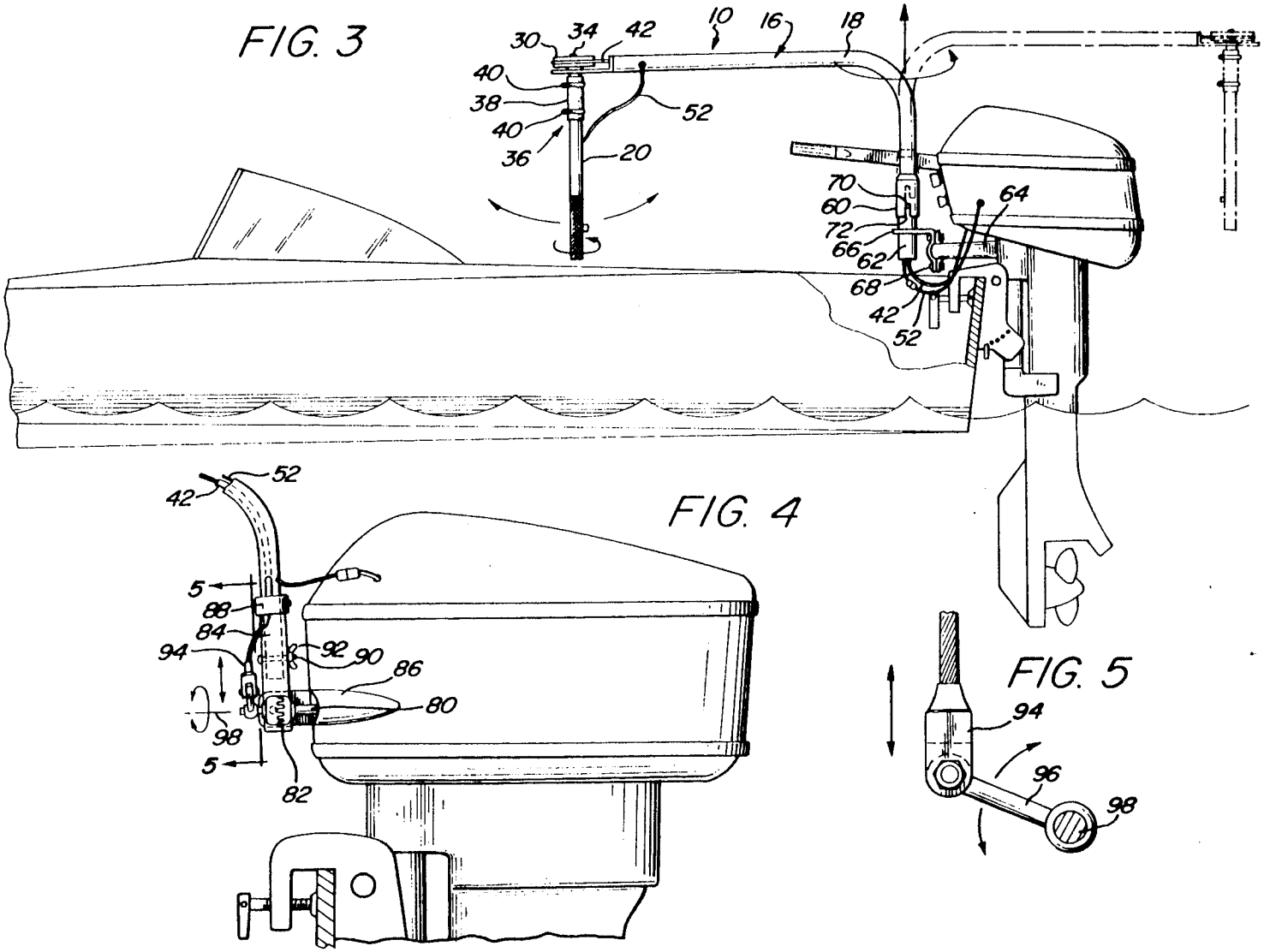
FIG. 3 is a side elevational view of another embodiment of a remote control tiller arm shown attached to an outboard motor.
FIG. 4 is a partial side view showing another arrangement for mounting the remote control tiller arm to an outboard motor.
FIG. 5 is a partial transverse section view of the throttle control connection at the outboard motor in the plane of 5—5 of FIG. 4.

Another mounting means for mounting steering boom arm 16 to an outboard motor is illustrated in FIG. 3. The mounting end of L-shaped tube 18 terminates in a larger diameter sleeve 60. This larger diameter sleeve 60 slides and seats over short mounting tube 62 which is affixed to the motor cross arm 64 by bracket means 66 and bolts and nuts 68. A cross-pin 70 extends traversely through mounting tube 62 seating within slots 72 in the end of larger diameter sleeve 60. The cross-pin 70 keeps the steering boom arm 16 from rotating while the steering boom arm is swung from side to side during steering operation. However, when not in use, the steering boom arm 16 may be lifted and swung 180 degrees rearwardly and reseated over mounting tube 62 and cross-pin 70. The steering boom arm 16 will thus be out of the way so anyone in the boat can engage in activities without the steering boom arm 16 being in the way.

The throttle means is similar to the above-described embodiment with depending rod 20 affixed to pulley 30 and pulley pin 34 by universal joint 36. The throttle cable attached to pulley 30 extends through L-shaped tube arm 18 and out through mounting tube 62 and to motor throttle mechanism (now shown). A kill switch 50 may also be employed. The end portion of downwardly depending rod 20 may be knurled to enhance grasping ability in wet conditions.

FIGS. 4 and 5 illustrate another means for mounting a remote control tiller arm to an outboard motor. In this arrangement, outboard motor 12 has a motor throttle shaft 80 and complementary meshing gears 82 extending therefrom. Mounting tube 84 at one end is securely affixed to motor throttle cover 86, such as by welding for example. L-shaped rigid tube 18 of steering boom arm 16 has collar 88 mounted thereon a short distance up from the mounting end of tube 18. L-shaped tube 18 is slidably inserted into mounting tube 84 and affixed into proper position by headed screw 90 extending through both the mounting tube 84 and L-shaped tube 18. The screw is held by wing nut 92. A conventional push-pull throttle cable 43 may be employed in the embodiment of FIGS. 3 and 4 in which a cable sheath 43*a* is affixed at each end to the tube 18 (see clamp 88, FIG. 4) with the moveable cable 43 deposed within the sheath and fastened at one end to the pulley 30 and at the other end to a slotted end connector 92. The slotted end connector 94 is bolted to the end of link 96, the other end of link 96 being affixed to motor throttle complementary mesh gear shaft 98. In operation, the push-pull throttle cable 43 is tensioned or compressed, pulling or pushing and swinging link 96 to turn the motor throttle complementary meshing gears 82 and throttle shaft 80. This action rotates the shaft 98 clockwise or counterclockwise to increase or decrease motor speed thus increasing the engine speed.

Figure 6:
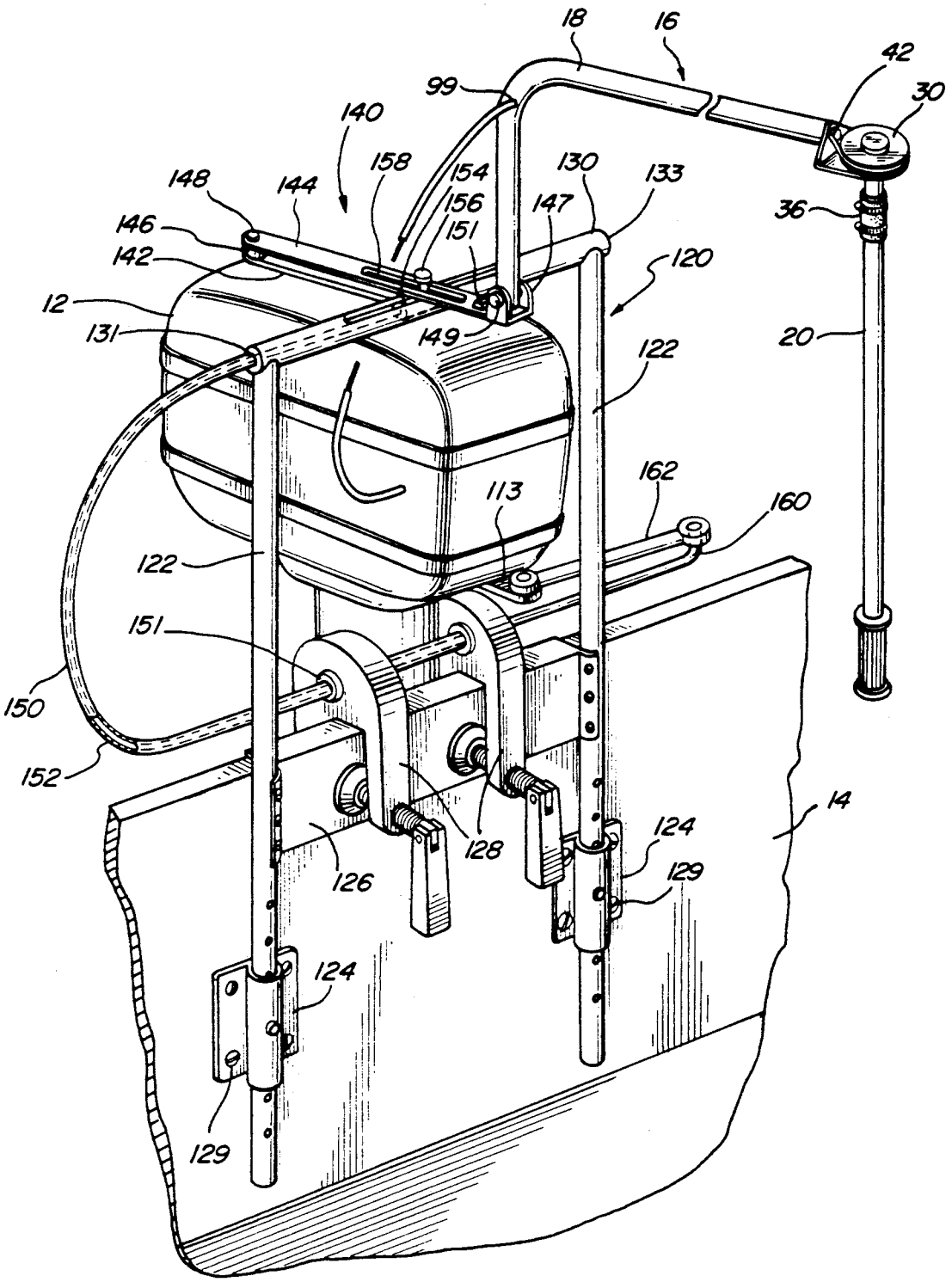
FIG. 6 is a partial perspective view of an alternative embodiment of a tiller arm steering control arrangement for a remote control tiller arm providing indirect corrected reversing steering control.
Figure 7:
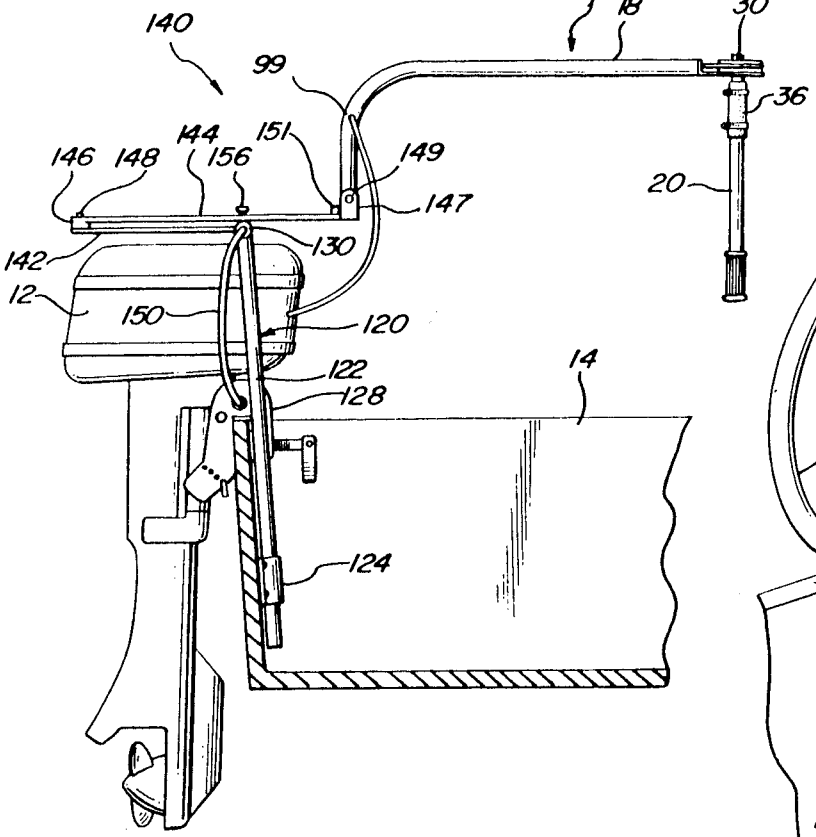
FIG. 7 is a side view of the tiller arm steering control connection arrangement shown in FIG. 6.

An alternative embodiment for a tiller arm arrangement is illustrated in FIGS. 6 and 7. This embodiment features an indirect corrected reversing steering control means which directs the boat in the direction the steering boom arm is swung. The reversing steering means of this particular embodiment includes a steering boom arm 16 as described above which comprises L-shaped rigid tube 18 and downwardly depending rod 20. The L-shaped rigid tube 18 is coupled to an outboard motor 12 by frame means 120 and steering linkage means 140. Frame means 120 includes two vertical elongated tubular members 122 which are affixed to the transom 14*a* of boat 14 by brackets 124 bolted to the transom of boat 14, and also includes an elongated right angle bracket 126 which is affixed to the transom by outboard motor clamps 128 and to the two vertical elongated members 122 by screws 129. Frame means 120 further includes horizontal tube 130 which is attached between the upper ends of vertical elongated tubular members 122, such as by welding, for example. Horizontal tube 130 has an open end 131 and a closed end 133.

Steering linkage means 140 includes flat elongated plate member 142 affixed, by welding for example, to the bottom portion of horizontal tube member 130, which plate member extends rearwardly therefrom. Swing arm 144 comprises flat elongated plate having at one end thereof a disc-shaped embossment 146 with a hole therethrough and at the other end an elongated longitudinally disposed elongated slot 158. The embossment is rotably attached to the end of flat elongated plate member 142 by means of pin 148. The steering boom arm 16 is pivotally attached to the other end of swing arm 144 within upstanding ears 147 by cross-pin 149. Stop 151 behind upstanding ears 147 keeps steering boom arm 16 in its upright position during use. However, the steering arm 16 may be pivoted up and backwards to move it out of the way so as not to encumber any activity within the boat 14 when at rest. A J-shaped push-pull tube 150 is attached to open end 131 of horizontal tube 130 and loops through holes 151 in motor clamps 128. A sliding push-pull cable 152 is attached to slide plug 154, which in turn is slidably pinned by headed pin 156 within elongated slot 158 in swing arm 144. An elbowed rod 160 is attached to the other end of sliding push-pull cable 152, a portion of elbowed rod 160 being slidably mounted within push-pull tube 150. The elbowed end of rod 160 is coupled to the motor steering arm bracket 113 by linkage rod 162.

In operation, the steering boom arm 16 is swung to the right, for example, which pushes push-pull sliding cable 152 through push-pull tube 150 and consequently pushes elbowed rod 160 outwardly and to the left such that linkage rod 162 pulls motor 12 to the left. Accordingly, when the steering boom is swung to the right, the boat turns right. Oppositely, when the steering boom is swung to the left, the boat will turn to the left. The direct steering means makes for easier boat handling since the boat will be directed in the direction the steering boom arm is turned. This is especially advantageous for novice or inexperienced boat handlers and may reduce collisions or other boating accidents The motor speed may be regulated by similar throttle control arrangement as described more particularly above wherein downwardly depending rod 20 is coupled by universal joint 36 to a pulley 30 and throttle cable 42. The throttle cable 42 extends through L-shaped rod portion and out a hole 99 therein and is attached to the outboard motor throttle control linkage (not shown).

Figure 8:
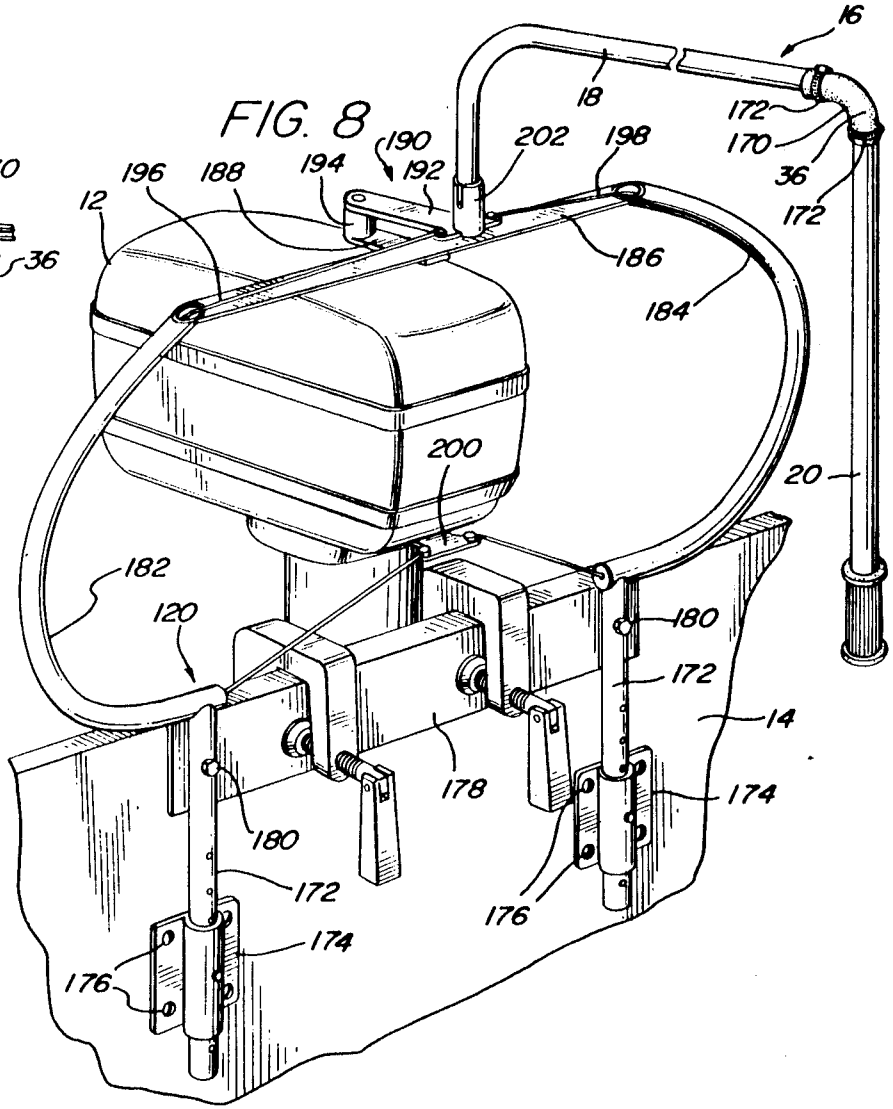
FIG. 8 is another embodiment of a tiller arm steering control arrangement for providing direct steering control.

An alternative reversing steering arrangement is illustrated in FIG. 8 having a steering boom arm 16 comprised of L-shaped tube 18 and downwardly depending rod 20 which are coupled together by universal joint 36. Universal joint 36 may be a thick elbow-shaped hose piece 170 clamped to the L-shaped tube arm 18 and downwardly depending rod 20 by hose clamps 172. The frame means 180 for this steering arrangement includes vertical beam members 172 mounted against the transom inner wall by brackets 174 and bolts 176, and further includes right angle cross member 178 mounted on the upper portion of the transcom by bolts 180 extending through vertical members 172, cross member 178 and the boat transom.

Two C-shaped cable tubes 182, 184 are mounted on and attached to the upper surface of right angle cross member 178 and also to vertical members 172, such as by welding for example. Cable tubes 182, 184 extend upwardly from the cross member 178 and are attached at their upper portion by cross plate 186 by welding for example The respective lower and upper openings of the cable tubes 182, 184 are essentially oppositely disposed. Steering linkage means 190 comprises a rearwardly projecting plate 188 affixed to the central portion of cross plate 186. Rearwardly projecting plate 188 having disc-shaped embossment 194 thereon is rotably pinned onto the rear portion of swing arm 192. Right and left cables 196, 198 are attached to the front portion of swing arm 190 and extend through cable tubes 182, 184 respectively and are attached to the front portion of motor 12 via plate 200. The L-shaped tube 18 is affixed to the swing arm 192 by inserting one end thereof into mounting tube portion 202. The downwardly depending rod 20 can be swung from side to side to pull cables 196, 198 through the cable tubes 182, 184 and turn motor 12 from side to side Accordingly, when the steering boom arm 16 is swung to the right, the motor 12 will swing to the left and the boat 14 will turn to the right, and visa versa, when the steering boom is swung to the left.

Figure 9:
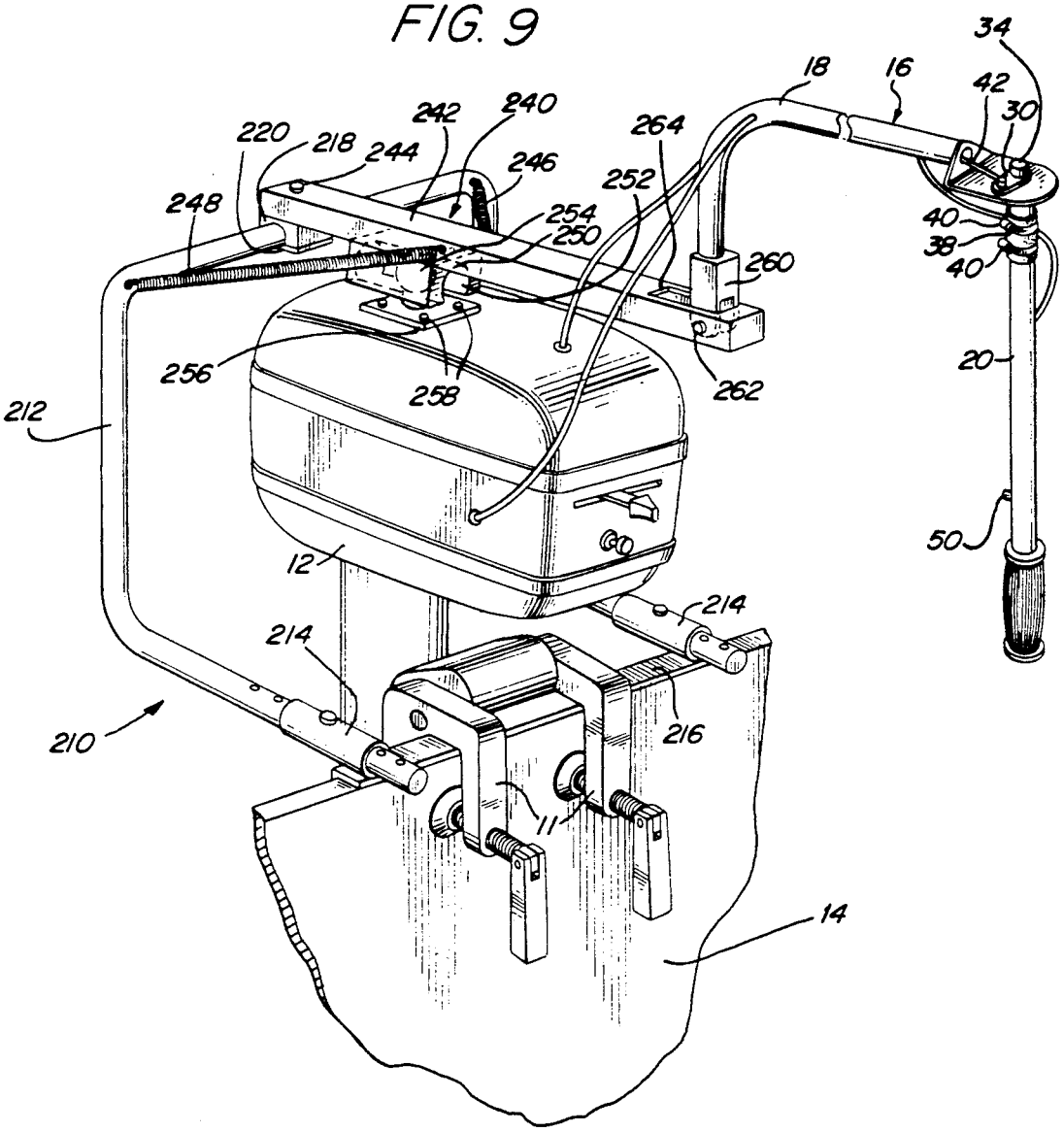
FIG. 9 is still another embodiment of a tiller arm steering control arrangement for providing direct steering control.
Figure 10:
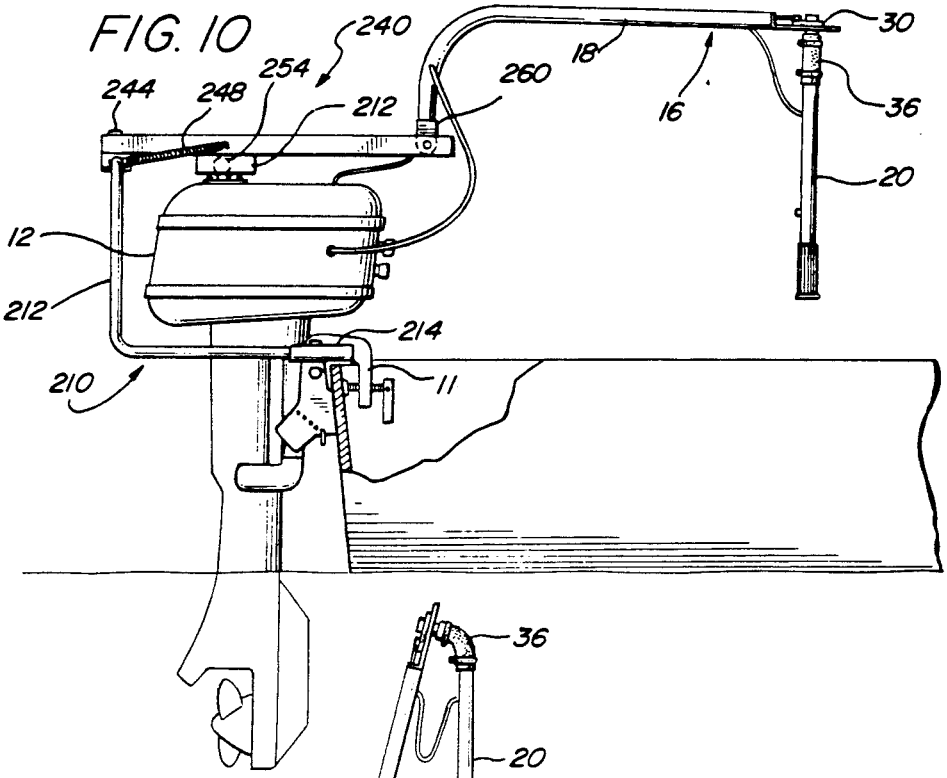
FIG. 10 is a side view of the steering control connection arrangement shown in FIG. 9.
Figure 11:
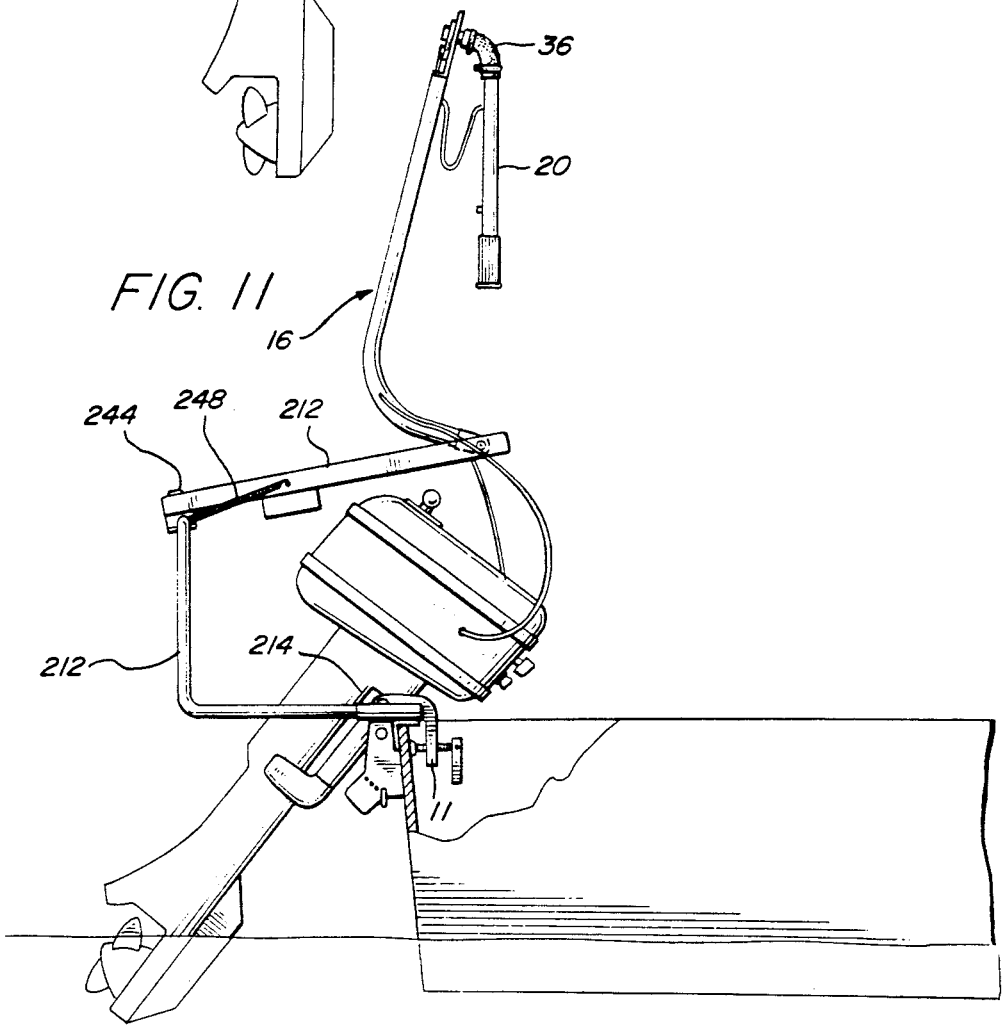
FIG. 11 is a side view of the steering control connection arrangement shown in FIG. 9 in a tilted up and back position.

In FIGS. 9, 10 and 11 another direct remote control steering arrangement is shown employing the steering boom arrangement 16 described above attached to steer outboard motor 12 by steering linkage means 240 The steering linkage means 240 is supported by frame means 210 which comprises frame tubular member 212 attached to the transom 14*a* of a boat 14 by means of mounting tubes 214 and right angle cross member 216. The right angle cross member 216 seats on top of the transom and is held securely thereto by outboard motor mounting clamps 11. Mounting tubes 214 are traversely affixed to cross member 216 by welding, for example. The ends of frame tubular member 212 are slidably inserted within mounting tubes 214. The frame tubular member 212 extends rearwardly from mounting tubes past the extent of the outboard motor 12 and upwardly and across in a U-shaped manner behind and above the outboard motor 12. Block member 218 is rotatably mounted on the upper portion of the frame tubular member and affixed thereto by attachment plate 220 and bolts (not shown).

Steering linkage means 240 comprises an elongated linkage arm 242 pivotally attached at one end to block member by pin 244. Return springs 246, 248 and attached between the elongated linkage arm 242 and the outer portions of frame tubular member 212 assists return of the steering boom arm 16 to a neutral forward position coincident with or parallel to the longitudinal axis of the boat (extending from the bow to the stern). Socket member 250 mounted under linkage arm 242 has an elongated channel shaped socket 252 longitudinally aligned with linkage arm 242. A ball 254 mounted on the top of outboard motor 12 (and rearward of the rotational axis of the motor) by mounting plate 256 and bolts 258, seats within the elongated channel shaped socket 252 such that the socket member 250 and linkage arm 242 are supported by ball 254.

The steering boom arm 16 is attached to the forward end of linkage arm. L-shaped tubular member 18 has a block shaped end portion 260 affixed thereto which is pinned by pin 262 within slotted hole 264. The block shaped end portion seats against the front end of the slot which holds steering boom arm in its normal upright position. As shown more particularly in FIG. 11, the boom arm may be titled rearwardly to get it out of the way when not in use. Additionally, the outboard motor may be tilted forward for storage or inspection of the prop as may be necessary.

The throttle mechanism includes the downwardly depending arm 20, universal joint 36, pulley 30 and cable arrangement 43, described above.

The steering arrangements described above all provide simplicity and reliability. These tiller arm arrangements may be installed by lay persons without any special skill or training using ordinary hand tools. Further more, while the above-described detailed description of a preferred embodiment describes the best mode contemplated by the inventor for carrying out the present invention at the time this application was filed and is offered by way of example and not by way of limitation Accordingly, various modifications may be made to the above-described preferred embodiment without departing from the scope of the invention. As an example, the steering linkage between the steering boom arm 16 and the motor may include pulleys reversing the direction of motor rotation relative to the direction of rotation of the boom arm. Accordingly, it should be understood that although the invention has been described and shown for a particular embodiment, nevertheless various changes and modifications obvious to a person of ordinary skill in the art to which the invention pertains are deemed to lie within the spirit and scope of the invention as set forth in the following claims.

What is claimed is:

1. A steering arrangement for allowing an operator to control the direction of an outboard motor which is attached to a transom of a boat by outboard motor brackets, comprising:

frame means attached to the transom of the boar;

a swing arm means pivotally attached to the frame means, the swing arm being generally in the form of an inverted U;

a push-pull tube attached to the frame means; and a push-pull cable slidably inserted within said push-pull tube between the swing arm means and the outboard motor such that side to side movement of the swing arm by the operator turns the outboard motor in a side to side fashion in a direction opposite to the movement of the swing arm.

2. A tiller steering arm arrangement for use by an operator of a motor boat having an outboard motor pivotally secured to a transom of the boat comprising:

a steering boom arm having one end adapted for attachment to the motor and a forward end, the boom arm being generally in the form of an inverted U-shaped structure; and means for attaching said one end of the steering boom arm to the outboard motor, the boom arm extending upwardly from the motor, then forwardly over a portion of the boat and then downwardly whereby the boat operator may be seated in the boat, under the boom arm, in a forward locking position and steer the boat by moving the forward end of the boom arm from side to side.

3. The tiller steering arm arrangement defined in claim 2 wherein said inverted U-shaped structure comprises an L-shaped rigid member having two legs and a downwardly depending member, one leg of the L-shaped rigid member attached to the outboard motor by said attaching means and the other leg of the L-shaped member attached to the downwardly depending member.

4. The tiller steering arm arrangement defined in claim 3 further comprising universal joint means for tiltably attaching the downward depending member to said other leg of the L-shaped rigid member.

5. The tiller steering arm arrangement defined in claim 4 wherein said universal joint means comprises a universal joint secured to the downwardly depending member and said other leg of the L-shaped rigid member.

6. The tiller steering arm arrangement defined in claim 3 wherein the downwardly depending member is mounted for axial rotation with respect to the L-shaped member and further comprising throttle means for controlling the speed of the outboard motor in response to the axial rotation of the downwardly depending member.

7. The tiller steering arm arrangement defined in claim 4 further comprising throttle means for controlling the speed of the outboard motor in response to the axial rotation of the downwardly depending member.

8. The steering arm defined in claim 7 wherein said throttle means comprises a pulley rotably attached to said other leg of the L-shaped member and a throttle cable means, the throttle cable means comprising a pair of cable sections extending from the pulley to the motor, said downwardly depending member being coupled to the pulley by said universal joint means to rotate it, thereby adjusting the length of the cable sections and motor speed.

9. The tiller steering arm arrangement defined in claim 3 further comprising kill switch means incorporated into the downwardly depending member.

10. The tiller steering arm arrangement defined in claim 3 further comprising means for tilting the steering boom arm up and over the outboard motor.

11. The tiller steering arm arrangement defined in claim 2 wherein said attaching means comprises an indirect reversing steering means for coupling the steering boom arm to the motor for steering the boat in the direction the steering boom arm is directed.

12. The tiller steering arm arrangement defined in claim 11 wherein the reversing steering means includes steering linkage means for directing the motor from side to side oppositely from the direction of the steering boom arm and frame means for mechanically supporting the steering linkage means and steering boom arm.

13. The tiller steering arm arrangement defined in claim 12 wherein the steering linkage means comprises a push-pull tube secured by said frame means, said push-pull tube having a push-pull cable therein, the push-pull cable attached at one end to the outboard motor by linkage rods and being coupled at the other end to the steering boom arm such that the movement of the arm causes the push-pull cable to slide back and forth within the push-pull tube and turn the outboard motor.

14. The tiller steering arm arrangement defined in claim 13 wherein said boom arm is coupled to the push-pull cable by a swing arm pivotally mounted with respect to the frame means, and a pin attached to a plug at said other end of the push-pull cable, the swing arm being arranged to slidably engage the pin.

15. The tiller steering arm arrangement defined in claim 12 wherein the steering linkage means comprises a linkage arm pivotally attached to said frame means and extending over the outboard motor, and ball and elongated track means attached to the top of said motor and steering linkage means such that pivotal movement of the linkage arm will cause the outboard motor to turn in the opposite direction.

16. The tiller steering arm arrangement defined in claim 15 further comprising spring bias means attached between the frame means and linkage arm to bias the boom arm toward the longitudinal axis of the boat.

17. The tiller steering arm arrangement defined in claim 15 wherein said frame means includes a elongated member attached to the transom of the motor boat and extending rearwardly and upwardly behind the motor.

18. The tiller steering arm arrangement defined in claim 17 wherein the elongated member is a tube.

19. The tiller steering arm arrangement defined in claim 12 wherein the steering linkage means comprises two C-shaped tubes mounted by said frame means on opposite sides of said one end of the steering boom arm, and two flexible cables coupled between the steering boom arm and the motor through respective ones of said C-shaped tubes such that swinging the boom arm from side to side causes the motor to be turned from side to side.

20. The steering arrangement defined in claim 2 wherein said inverted U-shaped boom arm comprises and L-shaped portion and a downwardly depending rod attached together by universal joint means.

21. The steering arrangement defined in claim 20 wherein said boom arm further comprises throttle means for regulating the speed of the outboard motor in response to the axial rotation of the downwardly depending rod.

22. A steering arrangement for controlling the direction of an outboard motor which is attached to a transom of a boat comprising:

two C-shaped tubular members each having upper and lower portions with openings at the ends thereof;

frame means for securing the lower portions of the C-shaped tubular members to the transom of a boat in spaced oppositely facing relationship;

bracket means for securing the upper portions of the C-shaped tubular members in a spaced oppositely facing relationship;

swing arm means pivotally attached to said bracket means between said upper openings of said C-shaped tubular members; and two cables attached to said swing arm means, each of said two cables extending through a respective one of said C-shaped tubular members and attached to the outboard motor such that swinging said swing arm means from side to side turns the outboard motor from side to side.

23. The steering arrangement defined in claim 22 wherein the swing arm means includes an arched shaped steering boom arm extending forwardly from the bracket means therefrom.

24. The steering arrangement defined in claim 22 wherein the bracket means comprises a cross-plate attached between the upper portions of said two C-shaped tubular members.

25. The steering arrangement defined in claim 22 wherein said frame means comprises two vertical beam shaped members rigidly attached to the transom and a right angle cross-plate secured to the top portion of the transcom, the lower portions of the C-shaped tubular members affixed to the right angle cross-plate and the two vertical beam shaped members.

26. The steering arrangement defined in claim 25 wherein said swing arm is rotably pinned to an arm member extending rearwardly from said cross-plate.

27. The steering arrangement defined in claim 23 wherein said boom arm is shaped generally in the form of an inverted U.

28. A steering arrangement for controlling the direction of an outboard motor which is attached to a transom of a boat, comprising:

frame means attached to the transom of the boat and extending above and behind the outboard motor;

a swing arm pivotally attached to said frame means at a point where the frame means extends above and behind the outboard motor, said swing arm extending upwardly from the frame means, then forwardly over a portion of the boat and then downwardly whereby a boat operator may be seated in a forward looking position behind the downwardly extending portion of the swing arm and steer the boat by moving the downwardly extending portion thereof from side to side; and ball and socket means cooperatively attached between the top of the outboard motor and the swing arm to turn the outboard motor oppositely in response to side to side movement of said swing arm.

29. The steering arrangement defined in claim 28 wherein said ball and socket means comprises a ball attached to the top of the outboard motor and an elongated socket member attached to the bottom of said swing arm.

30. The steering arrangement defined in claim 28 further comprising spring means attached between said frame means and swing arm to bias said swing arm toward the longitudinal axis of the boat.

31. The steering arrangement defined in claim 28 wherein said frame means comprises a U-shaped member having two end portions which are attached to a wall of the transom, the U-shaped member extending behind and above the outboard motor.

32. The steering arrangement defined in claim 31 further including attaching means to enable said U-shaped member to be detachably mounted to the wall of the transom of the boat.

33. The steering arrangement defined in claim 32 wherein said swing arm includes an arch shaped boom arm extending forwardly over the boat.

34. The steering arrangement defined in claim 33 wherein said boom arm comprises a rigid L-shaped member having two legs and a downwardly depending rod, one leg of the L-shaped member being attached to the outboard motor with the downwardly rod mounted for axial rotation to the other leg of the L-shaped member and wherein the boom arm further comprises throttle means for regulating the speed of the outboard motor in response to the axial rotation of the downwardly depending rod.

* * * * *

UNITED STATES PATENT AND TRADEMARK OFFICE

CERTIFICATE OF CORRECTION

PATENT NO. : 5,279,242

DATED : 1/18/94

INVENTOR(S) : W. Grant Johnson

It is certified that error appears in the above-identified patent and that said Letters Patent is hereby corrected as shown below:

On the Title Page, Item [57];
In the Abstract, line 4, after "over" delete "-".

Column 4, line 18, after "position" insert --.--.

Column 6, line 47, after "example" insert --.--.

Column 6, line 62, after "side" (second occurence) insert --.--.

Column 7, line 58, after "limitation" insert --.--.

Column 8, line 9, delete "boar" and insert --boat--.

Signed and Sealed this

Thirty-first Day of May, 1994

Bruce Lehman

*Attest:*

BRUCE LEHMAN

*Attesting Officer*

*Commissioner of Patents and Trademarks*